US006542867B1

(12) United States Patent
Sun et al.

(10) Patent No.: US 6,542,867 B1
(45) Date of Patent: Apr. 1, 2003

(54) SPEECH DURATION PROCESSING METHOD AND APPARATUS FOR CHINESE TEXT-TO-SPEECH SYSTEM

(75) Inventors: Shih Chang Sun, Hsintien (TW); Chin Yun Hsieh, Taoyuan Hsien (TW)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/536,750

(22) Filed: Mar. 28, 2000

(51) Int. Cl.[7] ..... G10L 13/00; G10L 13/08
(52) U.S. Cl. ..... 704/260; 704/267
(58) Field of Search ..... 704/258, 260, 704/266, 267, 269

(56) References Cited

U.S. PATENT DOCUMENTS

| | | | | | |
|---|---|---|---|---|---|
| 5,384,893 | A | * | 1/1995 | Hutchins | 704/258 |
| 5,615,300 | A | * | 3/1997 | Hara et al. | 347/240 |
| 5,950,162 | A | | 9/1999 | Corrigan et al. | |
| 6,260,016 | B1 | * | 7/2001 | Holm et al. | 704/200 |
| 6,330,538 | B1 | * | 12/2001 | Breen | 704/260 |

FOREIGN PATENT DOCUMENTS

| | | |
|---|---|---|
| CN | 170052 | 1/1980 |
| EP | 0689192 | 12/1995 |
| EP | 0752698 | 1/1997 |
| WO | 96/42079 | 12/1996 |

OTHER PUBLICATIONS

English Language Abstract of CN 1115442A.

* cited by examiner

*Primary Examiner*—Marsha D. Banks-Harold
*Assistant Examiner*—Martin Lerner
(74) *Attorney, Agent, or Firm*—Greenblum & Bernstein, P.L.C.

(57) ABSTRACT

The duration of speech varies according to the characteristics of pronounced speech and pronouncing habit of the speaker. In the speech duration processing method and apparatus of this invention, a large amount of natural speech was analyzed, and the following was known: Speech duration of monosyllables will vary according to factors, such as phonemes, tones, phrase construction, locations in the phrases, locations in the sentence, and front and rear connected phonemes, etc. of the syllables. Through the use of these varying factors, a "speech duration parameter storage portion" for speech duration parameters is constructed. By retrieving the speech duration parameters and combining the same with the basic speech duration of a syllable during syllable speech duration calculation, the speech duration of each monosyllable in any sentence can be accurately decided. As recognized from experimental results, a text-to-speech system using the speech duration processing apparatus of this invention can synthesize speech with natural speech duration.

4 Claims, 12 Drawing Sheets

| VOCABULARY | PHONETIC MARKER | PART OF SPEECH | EXPANSION SYNTAX |
|---|---|---|---|
| 爺爺 | ie2 ie2 | N | Φ |
| 喜歡 | xi3 huan1 | V | Φ |
| 桌子 | zhuo1 z5 | N | Φ |
| 那張 | na4 zhang1 | J | AN |
| ·<br>· | | | |
| 我 | uo3 | N | AN |
| 最 | zuei4 | A | AV, AJ |
| 小 | ziao3 | J | AN |
| 的 | de5 | J | BN |
| 去 | qv4 | V | AN, AV |
| 地 | di4, di5 | N | BV |
| ·<br>· | | | |

FIG.3

| MONOSYLLABLE | PHONEME DESIGNATED NUMBER | |
|---|---|---|
| | CONSONANT DESIGNATED NUMBER | VOWEL DESIGNATED NUMBER |
| ·<br>·<br>· | | |
| uo | 0 | 47 |
| ·<br>·<br>· | | |
| ie | 0 | 37 |
| ·<br>·<br>· | | |
| zuei | 19 | 49 |
| ·<br>·<br>· | | |
| xi | 14 | 35 |
| ·<br>·<br>· | | |
| huan | 11 | 50 |
| ·<br>·<br>· | | |
| na | 7 | 22 |
| ·<br>·<br>· | | |
| zhang | 15 | 32 |
| ·<br>·<br>· | | |
| xiao | 14 | 39 |
| ·<br>·<br>· | | |
| zhuo | 15 | 47 |
| ·<br>·<br>· | | |
| z@ | 19 | 59 |

FIG.4

| PHONEME DESIGNATED NUMBER | PHONEME | BASIC SPEECH DURATION(ms) |
|---|---|---|
| ⋮ | ⋮ | ⋮ |
| 7 | n | 58 |
| ⋮ | ⋮ | ⋮ |
| 11 | h | 94 |
| ⋮ | ⋮ | ⋮ |
| 14 | x | 115 |
| 15 | zh | 65 |
| ⋮ | ⋮ | ⋮ |
| 19 | z | 58 |
| ⋮ | ⋮ | ⋮ |
| 22 | a | 145 |
| ⋮ | ⋮ | ⋮ |
| 32 | ang | 223 |
| ⋮ | ⋮ | ⋮ |
| 35 | i | 118 |
| ⋮ | ⋮ | ⋮ |
| 37 | ie | 271 |
| ⋮ | | |
| 39 | iao | 158 |
| ⋮ | ⋮ | ⋮ |
| 47 | uo | 159 |
| ⋮ | | |
| 49 | uei | 182 |
| 50 | uan | 292 |
| | ⋮ | ⋮ |
| 59 | @ | 150 |

FIG.5

| CONSONANT PARAMETER | | PARAMETER VALUE | | | | | |
|---|---|---|---|---|---|---|---|
| TONE (Tc) | FIRST TONE | 1 | | | | | |
| | SECOND TONE | 1.05 | | | | | |
| | THIRD TONE | 1.1 | | | | | |
| | FOURTH TONE | 1.05 | | | | | |
| | LIGHT TONE | 0.6 | | | | | |
| PHRASE CONSTRUCTION, LOCATION IN THE PHRASE (Pc) | | FIRST SYLLABLE | SECOND SYLLABLE | THIRD SYLLABLE | FOURTH SYLLABLE | . . . | nth SYLLABLE |
| | SINGLE-CHARACTER PHRASE | 1.0 | | | | | |
| | TWO-CHARACTER PHRASE | 0.98 | 0.99 | | | | |
| | THREE-CHARACTER PHRASE | 0.94 | 0.93 | 0.98 | | | |
| | FOUR-CHARACTER PHRASE | 0.94 | 0.91 | 0.93 | 0.98 | | |
| | FIVE-CHARACTER PHRASE | 0.94 | 0.91 | 0.95 | 0.91 | 0.98 | |
| | PHRASE WITH MORE THAN FIVE CHARACTERS | 0.94 | EVEN NUMBER OF SYLLABLES 0.91<br>ODD NUMBER OF SYLLABLES 0.93 | | | | 0.98 |
| LOCATION IN THE SENTENCE (Sc) | SENTENCE HEAD | 1 | | | | | |
| | SENTENCE TAIL (NON-LIGHT TONE) | 1.14 | | | | | |

FIG.6

| VOWEL PARAMETER | | PARAMETER VALUE | | | | | |
|---|---|---|---|---|---|---|---|
| TONE (Tv) | FIRST TONE | 1 | | | | | |
| | SECOND TONE | 1.25 | | | | | |
| | THIRD TONE | 1.3 | | | | | |
| | FOURTH TONE | 1.1 | | | | | |
| | LIGHT TONE | 0.78 | | | | | |
| PHRASE CONSTRUCTION, LOCATION IN THE PHRASE (Pv) | | FIRST SYLLABLE | SECOND SYLLABLE | THIRD SYLLABLE | FOURTH SYLLABLE | . . . | nth SYLLABLE |
| | SINGLE-CHARACTER PHRASE | 1.0 | | | | | |
| | TWO-CHARACTER PHRASE | 0.9 | 0.95 | | | | |
| | THREE-CHARACTER PHRASE | 0.85 | 0.8 | 0.9 | | | |
| | FOUR-CHARACTER PHRASE | 0.85 | 0.75 | 0.80 | 0.9 | | |
| | FIVE-CHARACTER PHRASE | 0.85 | 0.75 | 0.80 | 0.75 | 0.90 | |
| | PHRASE WITH MORE THAN FIVE CHARACTERS | 0.85 | EVEN NUMBER OF SYLLABLES 0.91<br>ODD NUMBER OF SYLLABLES 0.93 | | | | 0.9 |
| LOCATION IN THE SENTENCE (Sv) | SENTENCE HEAD | 1.28 | | | | | |
| | SENTENCE TAIL (NON-LIGHT TONE) | 1.56 | | | | | |

FIG.7

| VOWEL ENVIRONMENTAL EFFECT | | |
|---|---|---|
| REAR-CONNECTED PHONEME | | PARAMETER VALUE F(ms) |
| ⋮ | ⋮ | ⋮ |
| 7 | n | +5 |
| ⋮ | ⋮ | ⋮ |
| 11 | h | +5 |
| ⋮ | ⋮ | ⋮ |
| 14 | x | -8 |
| 15 | zh | -5 |
| ⋮ | ⋮ | ⋮ |
| 19 | z | +8 |
| ⋮ | ⋮ | ⋮ |
| 37 | ie | +5 |
| ⋮ | ⋮ | ⋮ |

FIG.8

PRIOR ART

SPEECH DURATION PROCESSING METHOD AND APPARATUS FOR CHINESE TEXT-TO-SPEECH SYSTEM

BACKGROUND OF THE INVENTION

1. Field of the Invention

The invention relates to a speech duration processing method and apparatus for deciding the speech duration of synthesized speech to obtain good sound quality.

2. Description of the Related Art

Using Chinese as an example, the synthesizing units used in a Chinese speech synthesizing system are generally classified into two types: (1) monosyllabic (408 kinds, not including the four tones); and (2) phonemes (including 21 Chinese phonetic consonants and 38 vowels). Regardless of whether monosyllables or phonemes are used as synthesizing units, some factors, such as the phonemes, tones, phrase construction, locations in phrases, locations in sentences, and the front and rear connected phonemes, of the synthesizing units appropriately decide the speech duration of each of the synthesizing units, and can have a large affect on the degree of natural likeness of synthesized speech.

A conventional speech duration processing apparatus for Chinese text-to-speech system has been disclosed in R.O.C. Patent Application No. 80100559, entitled "Speech Duration Processing Apparatus for Text-to-Speech System." FIG. 9 is a block diagram illustrating a speech duration processing apparatus for determining the speech duration according to the phonemes, tones and the locations in the sentence. As shown in FIG. 9, 110 denotes a memory portion for storing different data. 120 denotes a pinyin sentence input portion for inputting pinyin sentences of any length and formed from pinyin markers and tone markers. 130 denotes a syllable inspecting portion for inspecting syllables in the sentence inputted from the pinyin sentence input portion 120 with the use of the tone markers. 150 denotes a syllable-phoneme look-up memory portion for storing phonemes composed from each of the syllables. 140 denotes a phoneme inspecting portion for inspecting the phonemes in the inputted pinyin sentence with the use of the syllable-phoneme look-up memory portion 150, and for inspecting the location of each phoneme in the sentence. 170 denotes a speech duration numerical data storage portion for storing speech duration count data defined according to class of the phoneme, tone of the phoneme, and location of the phoneme in the sentence. 160 denotes a speech duration inspecting portion for calculating a syllable speech duration by using the inspected phoneme designated number, tones of each of the phonemes and locations of each of the phonemes in the sentence as indexing keys to retrieve the speech duration numerical data of each of the phonemes from the speech duration count data storage portion 170.

In the aforesaid conventional speech duration processing apparatus, only the phonemes, tones and locations of the phonemes in the sentence are considered. As to whether or not the synthesizing units form phrases and the effect of the locations thereof in phrases on the speech duration should be considered as well. For example, in a three-character phrase, the speech duration of the second character in the phrase is the shortest, followed by that of the first character, and the speech duration of the third character is the longest. In the example "我爺爺最, 喜歡那張, 小桌子", "我爺, 爺" forms a three-character phrase. The speech duration generated by the conventional speech duration processing apparatus for the first "爺" character and the second "爺" character is about 339 ms. However, the speech duration for natural language pronunciation as measured with the use of a sound registering instrument are 275 and 302 ms, respectively, thereby arising in a relatively large difference. Thus, the speech duration obtained by mere consideration of the phonemes, tones and the locations of the phonemes in the sentence are inaccurate and will result in lowering of the synthesized speech quality.

SUMMARY OF THE INVENTION

Therefore, the main object of the present invention is to provide a speech duration processing method and apparatus for Chinese text-to-speech system capable of overcoming the aforesaid drawback.

According to a first aspect of the invention, a speech duration processing method for Chinese text-to-speech system using Chinese phonemes as a basic processing unit, comprises:

- constructing a dictionary for storing Chinese vocabulary and corresponding information, such as phonetic markers, parts of speech, expansion syntax, etc.;
- constructing a syllable-phoneme look-up portion for storing information, such as phoneme designated numbers (including consonant designated numbers and vowel designated numbers) corresponding to each syllable for all of the Chinese syllables, etc.;
- constructing a basic speech duration storage portion for storing basic speech duration information classified according to phonemes;
- constructing a speech duration parameter storage portion for storing speech duration parameters according to tones of the syllables to which each of the phonemes belong, the phrase construction and the locations in the phrases, the locations in the sentence, and the class of the connected phonemes;
- inspecting positions of the syllables of each vocabulary in an input sentence of any length by comparing with the vocabulary stored in the dictionary;
- generating a phonetic representation of each syllable of each inspected vocabulary according to the phonetic markers stored in the dictionary;
- inspecting the part of speech and the expansion syntax of each inspected vocabulary with reference to the dictionary;
- combining the vocabulary in the sentence into phrases according to the expansion syntax and relationship of the parts of speech of adjacent ones of the vocabulary;
- inspecting each syllable in the generated text phonetic markers with the use of tone markers;
- inspecting the phoneme formation of each inspected syllable with reference to the information in the syllable-phoneme look-up portion;
- retrieving the speech duration of each inspected phoneme from the basic speech duration storage portion; and
- calculating the speech duration of each of the inspected phonemes that form each of the inspected syllables from the basic speech duration and the parameters associated with the tones, the phrase construction, the locations in the phrases, the locations in the sentence, and the class of the front and rear adjacent phonemes of the inspected phonemes, and tallying the speech duration of the inspected phonemes to obtain the speech duration of each of the inspected syllables.

According to a second aspect of the invention, a speech duration processing method for Chinese text-to-speech system using Chinese syllables as a basic processing unit, comprises:

constructing a dictionary for storing Chinese vocabulary and corresponding information, such as phonetic markers, parts of speech, expansion syntax, etc.;

constructing a basic speech duration storage portion for storing basic speech duration information classified according to the syllables;

constructing a speech duration parameter storage portion for storing speech duration parameters according to tones of each of the syllables, the phrase construction and the locations in the phrases, the locations in the sentence, and the class of the connected syllables;

inspecting positions of the syllables of each vocabulary in an input sentence of any length by comparing with the vocabulary stored in the dictionary;

generating a phonetic representation of each syllable of each inspected vocabulary according to the phonetic markers stored in the dictionary;

inspecting the part of speech and the expansion syntax of each inspected vocabulary with reference to the dictionary;

combining the vocabulary in the sentence into phrases according to the expansion syntax and relationship of the parts of speech of adjacent ones of the vocabulary;

inspecting each syllable in the generated text phonetic markers with the use of tone markers;

retrieving the speech duration of each inspected syllable from the basic speech duration storage portion; and calculating the speech duration of each of the inspected syllables from the basic speech duration and the parameters associated with the tones, the phrase construction, the locations in the phrases, the locations in the sentence, and the class of the front and rear adjacent syllables of the inspected syllables.

According to a third aspect of the invention, a speech duration processing apparatus for Chinese text-to-speech system using Chinese phonemes as a basic processing unit, comprises:

a dictionary for storing Chinese vocabulary and corresponding information, such as phonetic markers, parts of speech, expansion syntax, etc.; a syllable-phoneme look-up portion for storing information, such as phoneme designated numbers (including consonant designated numbers and vowel designated numbers) corresponding to each syllable for all of the Chinese syllables, etc.;

a basic speech duration storage portion for storing basic speech duration information classified according to the phonemes;

a speech duration parameter storage portion for storing speech duration parameters according to tones of the syllables to which each of the phonemes belong, the phrase construction and the locations in the phrases, the locations in the sentence, and the class of the connected phonemes;

a vocabulary inspecting portion for inspecting positions of the syllables of each vocabulary in an input sentence of any length by comparing with the vocabulary stored in the dictionary;

a phonetic marker generating portion for generating a phonetic representation of each syllable of each inspected vocabulary according to the phonetic markers stored in the dictionary;

a part of speech/expansion syntax inspecting portion for inspecting the part of speech and the expansion syntax of each inspected vocabulary with reference to the dictionary;

a phrase expansion portion for combining the vocabulary in the sentence into phrases according to the expansion syntax and relationship of the parts of speech of adjacent ones of the vocabulary;

a tone/syllable inspecting portion for inspecting each syllable in the generated text phonetic markers with the use of tone markers;

a phoneme inspecting portion for inspecting the phoneme formation of each of the inspected syllables with reference to the information in the syllable-phoneme look-up portion;

a basic speech duration deciding portion for retrieving the speech duration of each of the inspected phonemes from the basic speech duration storage portion; and a syllable speech duration calculating portion for calculating the speech duration of each of the inspected phonemes that form each of the inspected syllables from the basic speech duration and the parameters associated with the tones, the phrase constructions, the locations in the phrases, the locations in the sentence, and the class of the front and rear adjacent phonemes of the inspected phonemes, and for tallying the speech duration of the inspected phonemes to obtain the speech duration of each of the inspected syllables.

According to a fourth aspect of the invention, a speech duration processing apparatus for Chinese text-to-speech system using Chinese syllables as a basic processing unit, comprises:

a dictionary for storing Chinese vocabulary and corresponding information, such as phonetic markers, parts of speech, expansion syntax, etc.;

a basic speech duration storage portion for storing basic speech duration information classified according to the syllables;

a speech duration parameter storage portion for storing speech duration parameters according to tones of each of the syllables, the phrase construction and the locations in the phrases, the locations in the sentence, and the class of the connected syllables;

a vocabulary inspecting portion for inspecting positions of the syllables of each vocabulary in an input sentence of any length by comparing with the vocabulary stored in the dictionary;

a phonetic marker generating portion for generating a phonetic representation of each syllable of each inspected vocabulary according to the phonetic markers stored in the dictionary;

a part of speech/expansion syntax inspecting portion for inspecting the part of speech and the expansion syntax of each inspected vocabulary with reference to the dictionary;

a phrase expansion portion for combining the vocabulary in the sentence into phrases according to the expansion syntax and relationship of the parts of speech of adjacent ones of the vocabulary;

a tone/syllable inspecting portion for inspecting each syllable in the generated text phonetic markers with the use of tone markers;

a basic speech duration deciding portion for retrieving the speech duration of each inspected syllable from the basic speech duration storage portion; and a syllable speech duration calculating portion for calculating the speech duration of each of the inspected syllables from the basic speech duration and the parameters associated with the tones, the phrase constructions, the locations in the phrases, the locations in the sentence, and the class of the front and rear adjacent syllables of the inspected syllables.

According to the data construction and processing steps of the speech duration processing method of the first aspect of the invention, any length of a Chinese sentence waiting to be speech synthesized initially undergoes a vocabulary inspecting step, where the positions of the syllables of each vocabulary in the sentence are inspected by comparing with the vocabulary stored in a previously constructed dictionary. Then, each inspected vocabulary undergoes a phonetic marker generating step to generate a phonetic representation of each syllable according to the phonetic markers stored in the dictionary. Subsequently, via a part of speech/expansion syntax inspecting step, the part of speech and the expansion syntax of each vocabulary are inspected with reference to the dictionary. Further, in a phrase expansion step, adjacent ones of the vocabulary in the sentence are combined into phrases according to the expansion syntax and relationship of the parts of speech. Thereafter, via a tone/syllable inspecting step, each syllable in the generated phonetic markers of the sentence are inspected with the use of tone markers. Then, in a phoneme inspecting step, the phoneme formation of each syllable is inspected with reference to a previously constructed syllable-phoneme look-up portion. Subsequently, via a basic speech duration deciding step, the speech duration of each phoneme is inspected with reference to a previously constructed basic speech duration storage portion. Finally, in a syllable speech duration calculating step, the speech duration of each of the phonemes that form each of the syllables in the sentence is calculated from the basic speech duration and the parameters associated with the tones, the phrase constructions, the locations in the phrases, the locations in the sentence, and the class of the front and rear adjacent phonemes of the phoneme formation, and the speech duration of the phonemes that comprise each syllable are tallied to obtain the syllable speech duration. From the result, a syllable speech duration that complies with natural speech can be obtained for the Chinese sentence waiting to be speech synthesized.

According to the data construction and processing steps of the speech duration processing method of the second aspect of the invention, any length of a Chinese sentence waiting to be speech synthesized initially undergoes a vocabulary inspecting step, where the positions of the syllables of each vocabulary in the sentence are inspected by comparing with the vocabulary stored in a previously constructed dictionary. Then, each inspected vocabulary undergoes a phonetic marker generating step to generate phonetic of each syllable according to the phonetic markers stored in the dictionary. Subsequently, via a part of speech/expansion syntax inspecting step, the part of speech and the expansion syntax of each vocabulary are inspected with reference to the dictionary. Further, in a phrase expansion step, adjacent ones of the vocabulary in the sentence are combined into phrases according to the expansion syntax and relationship of the parts of speech. Thereafter, via a tone/syllable inspecting step, each syllable in the generated phonetic markers of the sentence are inspected with the use of tone markers. Then, in a basic speech duration deciding step, the speech duration of each syllable is inspected with reference to a previously constructed basic speech duration storage portion. Finally, in a syllable speech duration calculating step, the syllable speech duration of each of the syllables in the sentence is calculated from the basic speech duration and the parameters associated with the tones, the phrase constructions, the locations in the phrases, the locations in the sentence, and the class of the front and rear adjacent syllables. From the result, a syllable speech duration that complies with natural speech can be obtained.

According to the construction of the speech duration processing apparatus of the third aspect of the invention, after any length of a Chinese sentence is inputted into the apparatus, a vocabulary inspecting portion inspects the positions of the syllables of each vocabulary in the sentence by comparing with the vocabulary stored in a previously constructed dictionary. Then, a phonetic marker generating portion inspects each vocabulary to generate phonetic of each syllable according to the phonetic markers stored in the dictionary. Subsequently, via a part of speech/expansion syntax inspecting portion, the part of speech and the expansion syntax of each vocabulary are inspected with reference to the dictionary. Further, via a phrase expansion portion, adjacent ones of the vocabulary in the sentence are combined into phrases according to the expansion syntax and relationship of the parts of speech. Thereafter, via a tone/syllable inspecting portion, each syllable in the generated phonetic markers of the sentence are inspected with the use of tone markers. Then, via a phoneme inspecting portion, the phoneme formation of each syllable is inspected with reference to a previously constructed syllable-phoneme look-up portion. Subsequently, via a basic speech duration deciding portion, the speech duration of each phoneme is inspected with reference to a previously constructed basic speech duration storage portion. Finally, via a syllable speech duration calculating portion, the speech duration of each of the phonemes that form each of the syllables in the sentence is calculated from the basic speech duration and the parameters associated with the tones, the phrase constructions, the locations in the phrases, the locations in the sentence, and the class of the front and rear adjacent phonemes of the phoneme formation, and the speech duration of the phonemes that comprise each syllable are tallied to obtain the syllable speech duration. The syllable speech duration is outputted for use.

According to the construction of the speech duration processing apparatus of the fourth aspect of the invention, after any length of a Chinese sentence is inputted into the apparatus, a vocabulary inspecting portion inspects the positions of the syllables of each vocabulary in the sentence by comparing with the vocabulary stored in a previously constructed dictionary. Then, a phonetic marker generating portion inspects each vocabulary to generate phonetic of each syllable according to the phonetic markers stored in the dictionary. Subsequently, via a part of speech/expansion syntax inspecting portion, the part of speech and the expansion syntax of each vocabulary are inspected with reference to the dictionary. Further, via a phrase expansion portion, adjacent ones of the vocabulary in the sentence are combined into phrases according to the expansion syntax and relationship of the parts of speech. Thereafter, via a tone/syllable inspecting portion, each syllable in the generated phonetic markers of the sentence are inspected with the use of tone markers. Then, via a basic speech duration deciding portion, the speech duration of each syllable is inspected with reference to a previously constructed basic speech duration storage portion. Finally, via a syllable speech duration calculating portion, the syllable speech duration of each of the syllables in the sentence is calculated from the basic speech duration and the parameters associated with the tones, the phrase constructions, the locations in the phrases, the locations in the sentence, and the class of the front and rear adjacent syllables. The syllable speech duration is outputted for use.

BRIEF DESCRIPTION OF THE DRAWINGS

Other features and advantages of the present invention will become apparent in the following detailed description of the preferred embodiments with reference to the accompanying drawings, of which:

FIG. 3 is a schematic diagram illustrating the construction of a dictionary of the preferred embodiment of the present invention, wherein Chinese terms are recorded in the "vocabulary" column; a phonetic marker corresponding to the vocabulary is stored in the "phonetic marker" column; the part of speech corresponding to the vocabulary is stored in the "part of speech" column, N indicates a noun, V indicates a verb, J indicates an adjective, A indicates an adverb . . . ; the syntax of an adjacent vocabulary for expansion into a phrase is stored in the "expansion syntax" column, AN: rear connected noun, BN: front connected noun, AV: rear connected verb, BV: front connected verb, AA: rear connected adverb, BA: front connected adverb, AJ: rear connected adjective, BJ: front connected adjective, ψ:no expansion syntax . . .

FIG. 4 is a construction diagram of a syllable-phoneme look-up portion of the preferred embodiment of the present invention.

FIG. 5 is a construction diagram of a basic speech duration storage portion of each phoneme according to the preferred embodiment of the present invention.

FIG. 6 is a construction diagram of a consonant parameter sub-portion of the preferred embodiment of the present invention.

FIG. 7 is a construction diagram of a vowel parameter sub-portion of the preferred embodiment of the present invention.

FIG. 8 is a construction diagram of a vowel environmental effect sub-portion for the effect of a phoneme on the speech duration of a front vowel according to the preferred embodiment of the present invention.

DETAILED DESCRIPTION OF THE PREFERRED EMBODIMENTS

Figure 1:
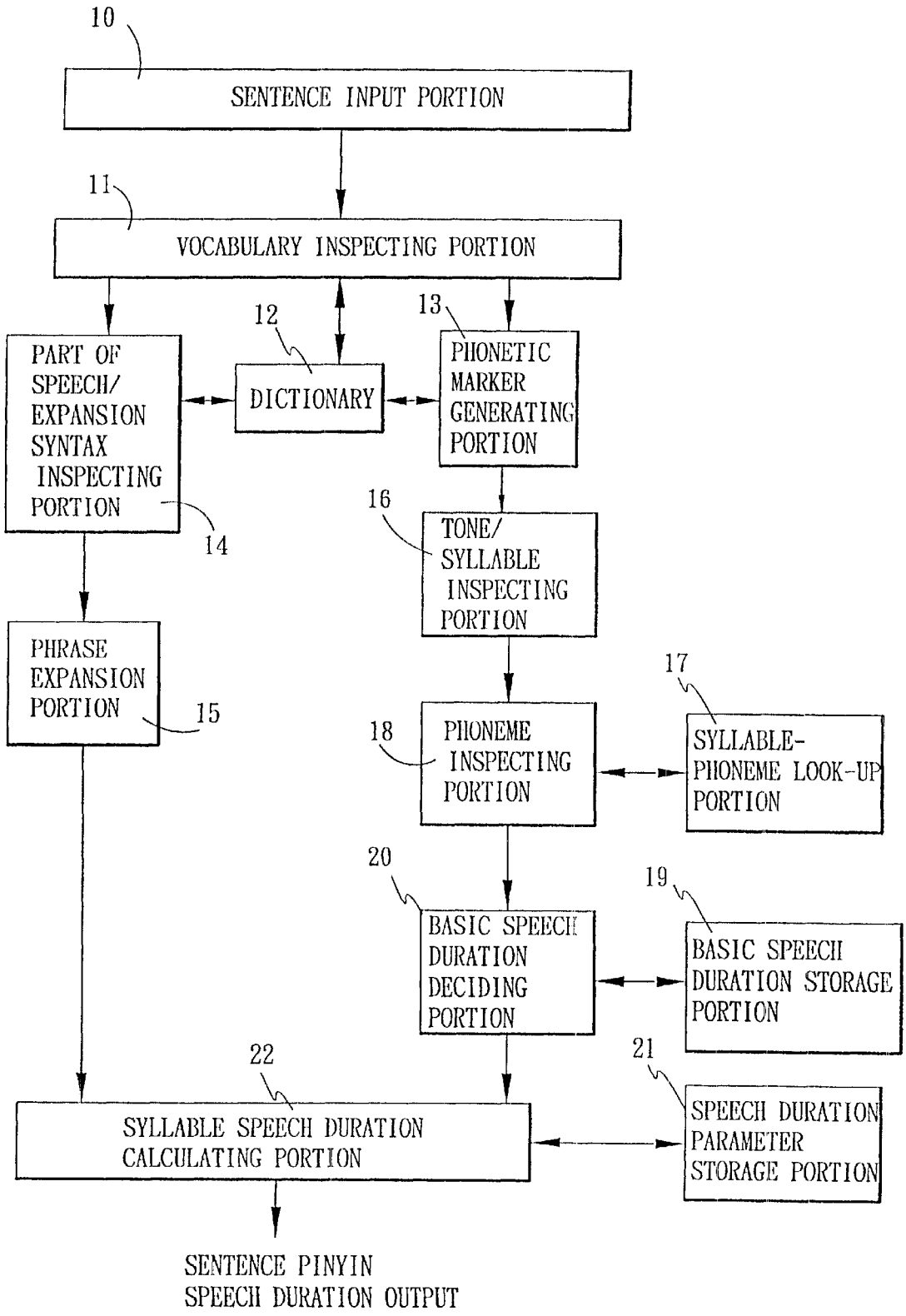
FIG. 1 is a system block diagram illustrating a preferred embodiment of a speech duration processing method and apparatus for Chinese text-to-speech system, which uses phonemes as a basic processing unit, according to the present invention.
Figure 2A:
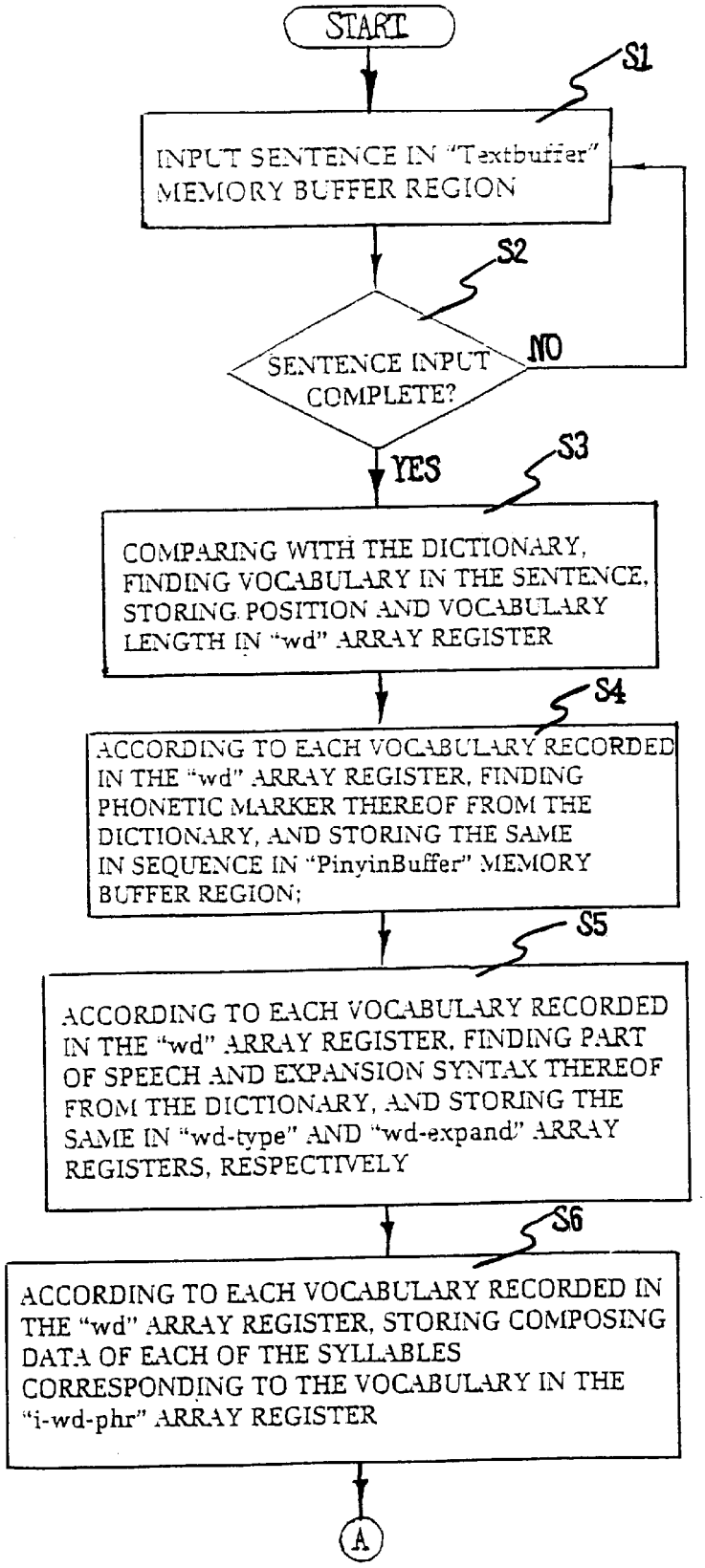
FIG. 2 composed of FIGS. 2A to 2D is an operational flow chart of the preferred embodiment of the present invention.
Figure 2B:
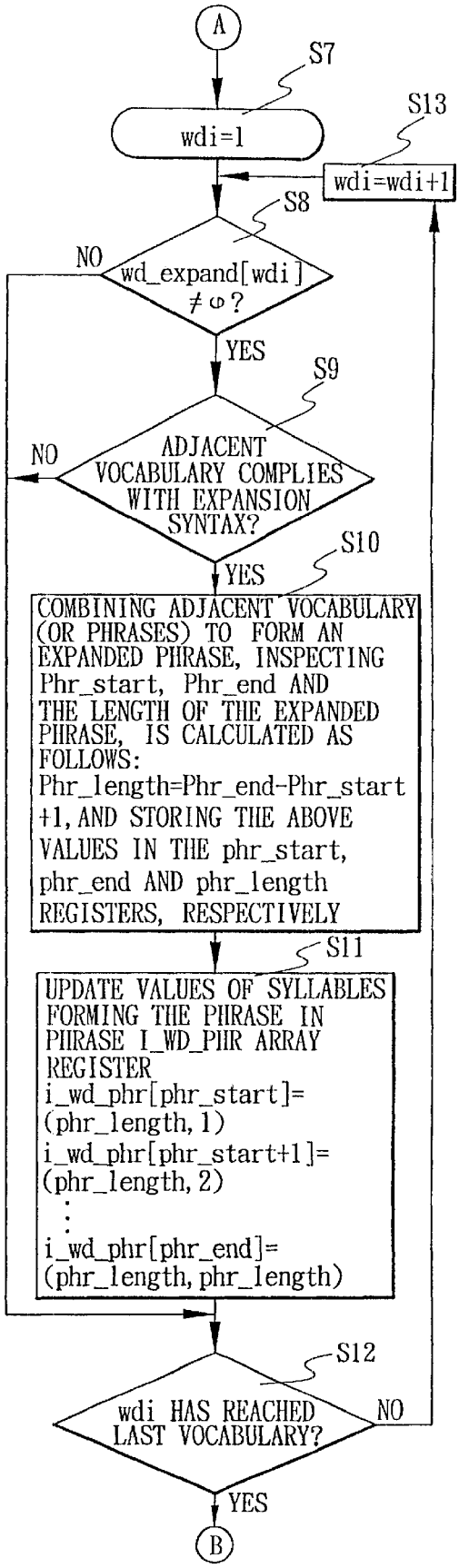
Figure 2C:
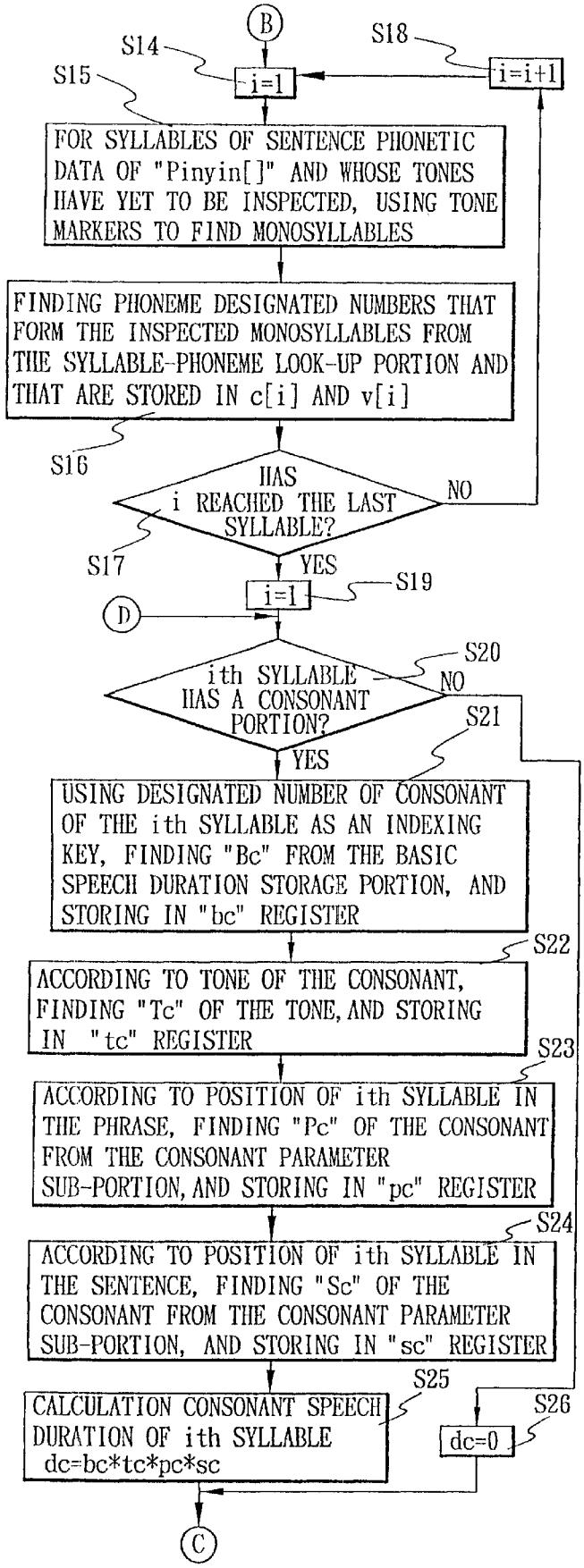
Figure 2D:
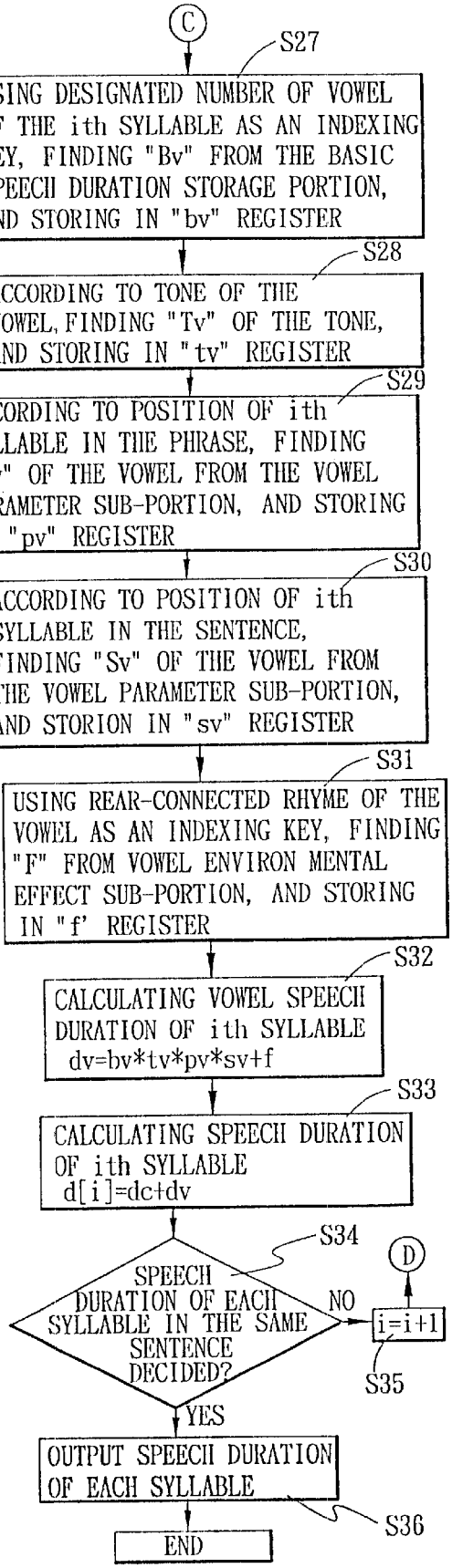
Figure 9:
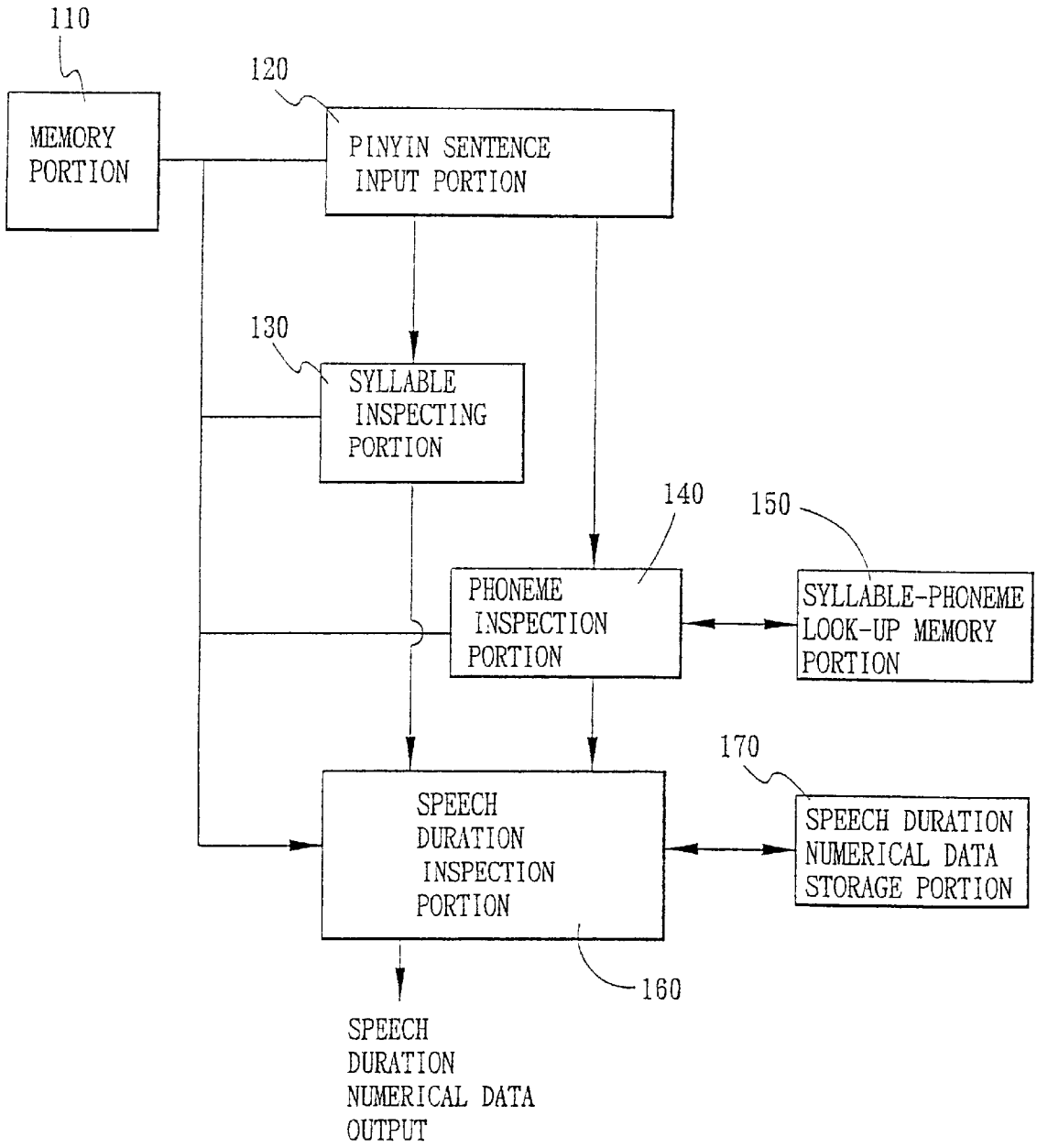
FIG. 9 is a block diagram of a conventional speech duration processing apparatus for text-to-speech system.

FIG. 1 is a system block diagram illustrating a preferred embodiment of a speech duration processing method and apparatus for Chinese text-to-speech system, which uses phonemes as a basic processing unit, according to the present invention. As illustrated in FIG. 1:

10 denotes a sentence input portion, such as one that can be formed from a keyboard, for inputting text of a sentence.

11 denotes a vocabulary inspecting portion for inspecting the locations of the syllables of each vocabulary in the input sentence by comparing with the vocabulary stored in a dictionary.

12 denotes a dictionary for storing Chinese vocabulary and corresponding information, such as phonetic markers, parts of speech, expansion syntax, etc. A schematic diagram illustrating the construction of the dictionary 12 is shown in FIG. 3.

13 denotes a phonetic marker generating portion for searching the phonetic markers, corresponding to each of the inspected vocabulary, from the dictionary.

14 denotes a part of speech/expansion syntax inspecting portion for searching the part of speech and the expansion syntax, corresponding to each of the inspected vocabulary, from the dictionary.

15 denotes a phrase expansion portion for expanding adjacent vocabulary into phrases with the use of the part of speech and the expansion syntax of each vocabulary.

16 denotes a tone/syllable inspecting portion for inspecting syllables in the generated phonetic markers using the tone markers, and for memorizing the inspected tones.

17 denotes a syllable-phoneme look-up portion for storing phonetic markers for each monosyllable, and designated numbers of the phonemes that form the same. A schematic diagram illustrating the construction of the syllable-phoneme look-up portion 17 is shown in FIG. 4.

18 denotes a phoneme inspecting portion for inspecting the phonemes, that form the tone-inspected syllables, with the use of the syllable-phoneme look-up portion 17, and for memorizing the phoneme data.

19 denotes a basic speech duration storage portion for storing basic speech duration of each of the phonemes obtained basically from statistical analysis of phoneme speech duration of a large amount of natural speech data. A schematic diagram illustrating the construction of the basic speech duration storage portion 19 is shown in FIG. 5, wherein "@" indicates a null vowel.

20 denotes a basic speech duration deciding portion for inspecting the basic speech duration of the inspected phonemes from the basic speech duration storage portion 19.

21 denotes a speech duration parameter storage portion constructed using information including tones, phrase construction and locations in the phrases for each of the phonemes, and the locations in the sentence and class of the connected phonemes, etc. In this embodiment, the speech duration parameter storage portion 21 is comprised of three storage sub-portions: a consonant parameter sub-portion and a vowel parameter sub-portion constructed from tones, phrase construction and locations in the phrases, and the locations in the sentence and the class of the connected phonemes for each of the phonemes, and a vowel environmental effect sub-portion constructed for the vowels according to the influence of a rear-connected phoneme on the speech duration of the vowels. Schematic diagrams which illustrate the construction of the speech duration parameter storage portion 21 are shown in FIGS. 6, 7 and 8.

22 denotes a syllable speech duration calculating portion for retrieving the speech duration parameters for the phonemes from the speech duration parameter storage portion 21 using information, including the tones, the locations in the phrases, the locations in the sentence and the class of the connected phonemes for the phonemes, as indexing keys; for calculating the speech duration for each phoneme from the basic speech duration and the parameters; and for tallying the speech duration of the phonemes to obtain the syllable speech duration.

When the present apparatus processes speech duration, different registers and memory buffer regions must be used. Although they are omitted and not shown in FIG. 1, they are necessary in actual practice, and include:

"TextBuffer" memory buffer region—for storing the text data of the input sentence;

"Pinyin" memory buffer region—for storing phonetic data of the input sentence;

"wdi" register—for storing designated number of a vocabulary in a sentence (using the numbers 1, 2, 3, . . . etc., e.g. 1 indicates the first vocabulary in the sentence);

"wd" array register—for storing values (vocabulary starting position, vocabulary length) of each inspected vocabulary in the input sentence. For example, wd[4]=(5,2) indicates that the fourth vocabulary in the sentence starts from the fifth syllable and has a vocabulary length of two syllables;

"wd type" array register—for storing the part of speech of each inspected vocabulary in the input sentence. For example, wd_type[2]=N indicates that the part of speech of the second vocabulary in the sentence is a noun;

"wd expand" array register—for storing the expansion syntax of each inspected vocabulary in the input sentence. For example, wd_expand[1]=AN indicates that the expansion syntax of the first vocabulary in the sentence is a rear-connected noun;

"i_wd_phr" array register—for storing values (phrase length, phrase location) of each phrase-forming syllable in the input sentence. For example, i_wd_phr [4]=(3,1) indicates that the fourth syllable in the sentence forms the first syllable of a three-syllable phrase;

"phr_start" register—for storing starting position of a phrase in the sentence;

"phr_end" register—for storing ending position of a phrase in the sentence;

"phr_length" register—for storing length of a phrase, units in terms of syllables;

"i" register—for storing position designated number (using the numbers 1, 2, 3 . . . etc.) of a syllable in the sentence;

"c" array register—for storing consonant designated number of each inspected syllable according to a phonetic representation of the input sentence;

"v" array register—for storing vowel designated number of each inspected syllable according to a phonetic representation of the input sentence;

"t" array register—for storing tone marker of each inspected syllable according to a phonetic representation of the input sentence;

"bc" array register—for storing consonant basic speech duration of an (i)th syllable from the basic speech duration storage portion according to t[i];

"tc" register—for storing tone parameter Tc of an (i)th syllable from the consonant parameter sub-portion according to t[i];

"sc" register—for storing position influencing parameter Sc inspected from the consonant parameter sub-portion according to position coordinate i (if it was detected that both c[i+1] and v[i+1] are equal to 0, this indicates that i is already at the sentence tail);

"pc" register—for storing phrase influencing parameter Pc inspected from the consonant parameter sub-portion according to i_wd_phr[i];

"dc" register—for storing consonant speech duration of an (i)th syllable in the sentence, where dc=bc*tc*sc*pc;

"bv" register—for storing vowel basic speech duration of an (i)th syllable from the basic speech duration storage portion according to t[i];

"tv" register—for storing tone parameter Tv of an (i) th syllable from the vowel parameter sub-portion according to v[i];

"sv" register—for storing position influencing parameter Sv inspected from the vowel parameter sub-portion according to position coordinate i (if it was detected that both c[i+1] and v[i+1] are equal to 0, this indicates that i is already at the sentence tail);

"pv" register—for storing phrase influencing parameter Pv inspected from the vowel parameter sub-portion according to i_wd_phr[i];

"f" register—for storing effect parameter F inspected from the vowel environmental effect sub-portion using c[i+1] as indexing key (if c[i+1]=0, then v[i+1] is used);

"dv" register—for storing vowel speech duration of an (i)th syllable in the sentence, where dv=bv*tv*sv*pv+F; and "d" array register—for storing the speech duration of an (i)th syllable in the sentence in d[i], where d[i]=dc+dv.

FIG. 2 shows an operational flow chart of the preferred embodiment of the speech duration processing apparatus for Chinese text-to-speech system, which uses phonemes as a basic processing unit. As illustrated in FIG. 2, In step S1, the text of the sentence are inputted into the TextBuffer memory buffer region.

In step S2, it is inspected if a current inputted text key is an end key for the text. If yes, the flow proceeds to step S3. Otherwise, the flow goes back to step S1.

In step S3, the text in the sentence is inspected to find each vocabulary in the sentence by comparison with the vocabulary in the dictionary, and the positions in the sentence and the vocabulary lengths are stored in the wd array register.

In step S4, according to each inspected vocabulary in the wd array register, the phonetic marker corresponding to each vocabulary are found from the dictionary and are stored in sequence in the Pinyin memory buffer region.

In step S5, according to each inspected vocabulary in the wd array register, the part of speech and the expansion syntax corresponding to each vocabulary are found from the dictionary and are stored in the wd_type and wd_expand array registers, respectively.

In step S6, according to each inspected vocabulary in the wd array register, composing data of each of the syllables corresponding to the vocabulary are stored in the i_wd_phr array register.

In step S7, the value in the wdi register is set to 1 for phrase expansion processing starting with the first vocabulary.

In step S8, it is determined if the (wdi)th vocabulary is an expansion syntax. (If the value is ψ, this indicates that the vocabulary has no expansion syntax). If yes, the flow proceeds to step S9. Otherwise, the flow proceeds to step S12.

In step S9, according to the expansion syntax, it is determined if the part of speech of the adjacent front or rear vocabulary complies with the expansion syntax. If yes, the flow proceeds to step S10. Otherwise, the flow proceeds to step S12.

In step S10, the phrase expansion operation begins. If expansion proceeds forward, wdi−1 is selected as the vocabulary to be expanded. If expansion proceeds rearward, wdi+is selected as the vocabulary to be expanded. If the vocabulary to be expanded has been deemed expanded into a phrase, this phrase is deemed to be a phrase to be expanded. The adjacent expanding vocabulary and the vocabulary to be expanded are combined to form an expanded phrase. The starting position Phr_start and the ending position Phr_end for the expanded phrase are found, and the length of the expanded phrase is calculated as follows: Phr_length=Phr_end—Phr_start+1. The starting position Phr_start, the ending position Phr_end, and the expanded phrase length Phr_length are subsequently stored in the phr_start, phr_end, and phr_length registers, respectively.

In step S11, the values of the corresponding syllables in the i_wd_phr array register are updated in accordance with the expanded phrase. Particularly, i_wd_phr[phr_start]=(phr_length, 1)

i_wd_phr[phr_start+1]=(phr_length, 2)

i_wd_phr[phr_end]=(phr_length, phr_length)

In step S12, it is determined if wdi has reached the last vocabulary. If yes, the flow proceeds to step S14 to end the phrase expansion operation. Otherwise, the flow proceeds to step S13.

In step S13, the value in the wdi register is incremented by 1, and the flow subsequently goes back to step S8 to continue with the phrase expansion operation.

In step S14, the value in the i register is set to 1, and serves as a coordinate for storing tones, consonants and vowels in the array registers.

In step S15, for syllables whose tones have yet to be inspected and stored in the Pinyin memory buffer region, tone markers are used to find monosyllables, and the syllable tone markers are stored in t[i].

In step S16, the phoneme designated numbers that form the inspected monosyllables are found from the syllable-phoneme look-up portion, wherein the consonant designated number is stored in c[i], while the vowel designated number is stored in v[i].

In step S17, it is determined if inspection of the sentence has been completed. If yes, the flow proceeds to step S19. Otherwise, the flow proceeds to step S18.

In step S18, the value in the i register is incremented by 1 unit, and the flow goes back to step S15.

In step S19, the value in the i register is reset to 1 for processing of the speech duration starting from the first syllable.

In step S20, it is determined whether the (i)th syllable includes a consonant portion. If yes, the flow proceeds to step S21. Otherwise, the flow goes to step S26.

In step S21, the speech duration Bc is found from the basic speech duration storage portion with the use of the designated number of the inspected constant as an indexing key, and is stored in the bc register.

In step S22, according to the tone of the syllable to which the consonant belongs, the consonant speech duration parameter Tc of the tone is found from the consonant parameter sub-portion and is stored in the tc register.

In step S23, according to the position of the syllable, to which the consonant belongs, in the phrase, the phrase influencing parameter Pc of the consonant is found from the consonant parameter sub-portion and is stored in the pc register.

In step S24, according to the position of the syllable, to which the consonant belongs, in the sentence, the influencing parameter Sc of the consonant is found from the consonant parameter sub-portion and is stored in the sc register.

In step S25, the consonant speech duration of the (i)th syllable is calculated (Dc=bc*tc*pc*sc), and is stored in the dc register. The flow then proceeds to step S27.

In step S26, because the syllable does not include a consonant portion, the value in the dc register is set to 0.

In step S27, the speech duration Bv is found from the basic speech duration storage portion with the use of the designated number of the inspected vowel as an indexing key, and is stored in the bv register.

In step S28, according to the tone of the syllable to which the vowel belongs, the vowel speech duration parameter Tv of the tone is found from the vowel parameter sub-portion and is stored in the tv register.

In step S29, according to the position of the syllable, to which the vowel belongs, in the phrase, the phrase influencing parameter Pv of the vowel is found from the vowel parameter sub-portion and is stored in the pv register.

In step S30, according to the position of the syllable, to which the vowel belongs, in the sentence, the influencing parameter Sv of the vowel is found from the vowel parameter sub-portion and is stored in the sv register.

In step S31, with the use of the rear-connected phoneme of the vowel as an indexing key, the effect parameter F is found from the vowel environmental effect sub-portion and is stored in the f register.

In step S32, the vowel speech duration of the (i)th syllable is calculated (Dv=bv*tv*pv*sv+f), and is stored in the dv register.

In step S33, the speech duration of the (i)th syllable is calculated (D=dc+dv), and is stored in the (i)th position of the d array register.

In step S34, it is determined if the speech duration of each syllable in the sentence has been decided. If yes, the flow proceeds to step S36. Otherwise, the flow proceeds to step S35.

In step S35, the value in the i register is incremented by 1 unit, and the flow goes back to step S20 to continue processing of speech duration data of the next syllable.

In step S36, the speech duration of each syllable of the entire sentence is outputted for use by a text-to-speech system, and the operation of the apparatus is ended.

To illustrate the operation of the aforesaid constructed speech duration processing apparatus for text-to-speech system of the preferred embodiment, the sentence "我爺爺最, 喜歡那張, 小桌子" is inputted in the following example:

The process flow of the example is as follows: In step S1, the sentence is inputted with the use of the sentence input portion 10, such as a keyboard. In step S2, input is ended upon detection of an end key in the text. Text data of the sentence "我爺爺最, 喜歡那張, 小桌子" is stored in the TextBuffer[ ] memory buffer region at this time.

Thereafter, in step S3, by comparing with the vocabulary in the dictionary 12, the vocabulary inspecting portion 11 inspects each vocabulary in the sentence: "我,", "爺爺,", "最,", "喜歡,", "那張,", "小,", "桌, 子 ," and records the starting position of each vocabulary in the sentence and the vocabulary character number in a series of number pairs (vocabulary starting position, vocabulary length) in wd[ ] of the array register. Thus, wd[1]=(1,1), - - - "我"

wd[2]=(2,2), - - -"爺爺"

wd[3]=(4,1), - - -"最"

wd[4]=(5,2), - - -"喜歡"

wd[5]=(7,2), - - -"那張"

wd[6]=(9,1), - - - "小"

wd[7]=(10,1) - - - "桌子"

Subsequently, in step S4, according to each vocabulary recorded in wd[ ], the phonetic marker generating portion 13 finds the phonetic marker corresponding to each vocabulary from the dictionary, and stores the same in sequence in the Pinyin memory buffer region PinyinBuffer [ ] . At this time, the phonetic representation string stored in the PinyinBuffer[ ] is "uo3ie2ie2zuei4xi3huan1na4zhang1xiao3zhuo1z5"

Then, in step S5, according to each vocabulary recorded in wd[ ], the part of speech/expansion syntax inspecting portion 14 finds the part of speech and expansion syntax for each vocabulary from the dictionary (the contents of which are such as those shown in FIG. 3), and stores the same in the wd_type and wd_expand array register, respectively. Thus, wd_type[1]=N, wd_expand[1]=AN; - - - "我"

wd_type[2]=N, wd_expand[2]=ψ; - - - "爺爺"

wd_type[3]=A, wd_expand[3]=AV,AJ; - - - "最"

wd_type[4]=V, wd_expand[4]=ψ; - - - "喜歡"

wd_type[5]=J, wd_expand[5]=AN; - - - "那張"

wd_type[6]=J, wd_expand[6]=AN; - - - "小"

wd_type[7]=N, wd_expand[7]=ψ- - - "桌子"

Next, the phrase expansion portion 15 is used to start the phrase expansion operation. Initially, in step S6, according to each inspected vocabulary in the wd array register, composing information of each of the syllables that correspondingly form the vocabulary are stored in the i_wd_phr array register in the format wd_phr[syllable position]= (phrase length, location in phrase). Thus,

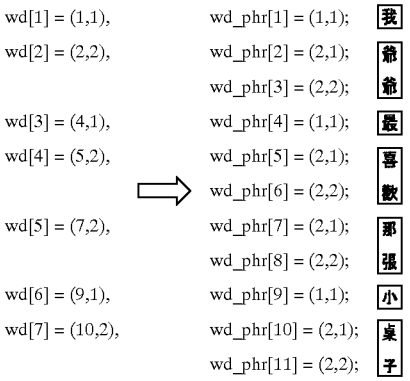

Thereafter, the value in the wdi register is set to 1 in step S7 to begin expansion operation of the first vocabulary "我 .". After it was determined that wd_expand[wdi]=AN in step S8, indicative of an expansion syntax with a rear-connected noun (≠ψ), the part of speech of the next vocabulary is inspected in step S9. At this time, wd_type[wdi+1]= N, indicative of a noun that complies with the expansion syntax AN, N. Thus, the (wdi)th vocabulary "我" and the (wdi+1)th vocabulary "爺爺" can be expanded to form a phrase. The new phrase expanded from wd_phr[1], wd_phr [2] and wd_phr[3] has a starting position Phr_start=1, an ending position Phr_end=3, and a phrase length Phr_ length=3−1+1=3, which are stored in the phr_start, phr_ end and phr_length registers, respectively, in step S10. Subsequently, the values, associated with this phrase that includes three syllables, in the i_wd_phr array register are updated in step S11 as follows:

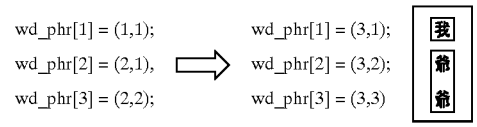

Then, since it is determined in step S12 that wdi has yet to reach the last vocabulary, the value of wdi is incremented by 1 unit in step S13 to continue with the expansion operation of the next vocabulary "爺爺.". After it was determined in step S8 that wd_expand[wdi]=ψ, because wdi has yet to reach the last vocabulary in step S12, the value of wdi is once again incremented by 1 unit in step S13, and step S8 is again performed. Thus, steps S8, S9, S10, S11, S12, S13 are repeated to process the third vocabulary, the fourth vocabulary, . . . up to the seventh vocabulary "桌子.". The phrase expansion operation is ended upon detection that the last vocabulary of the sentence has been reached in step S12. At this time, the values in wd_phr array register are as follows:

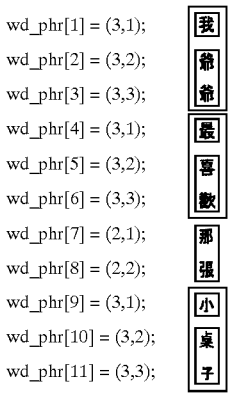

From the foregoing, it can be seen that, after the vocabulary "我,", "爺爺,", "最,", "喜歡,", "那張,", "小,", "桌, 子,", have undergone the phrase expansion operation, the phrases "我爺爺,", "最喜歡,", "那張,", "小桌子" can be obtained.

Next, the tone/syllable inspection operation begins. Initially, the value in the i register is set to 1 in step S14. In step S15, the tone/syllable inspecting portion 16 is used to inspect the first syllable "uo3," and the third tone thereof is stored in t[i] .Thereafter, in step S16, in connection with the monosyllable "uo," the phoneme inspecting portion 18 is used to search the syllable-phoneme look-up portion 17 (the contents stored therein are such as those shown in FIG. 4), and determines the phoneme designated numbers that form "uo" to be 0 (no consonant) and 47 (uo), which are stored in c[i] and v[i], respectively. Since it is determined in step S17 that the sentence tail has yet to be reached, the value of i is incremented by 1 unit in step S18, and the flow goes back to step S15. With the use of the tone/syllable inspecting portion 16 to inspect the second syllable "ie2," the second tone is stored in t[i] in step S15. Subsequently, in step S16, in connection with the monosyllable "ie," the phoneme inspecting portion 18 searches the syllable-phoneme look-up portion 17, and determines the phoneme designated numbers that form "ie" to be 0 (no consonant) and 37 (ie), which are stored in c[i] and v[i], respectively. Steps S15, S16, S17, and S18 are repeated until the sentence tail is reached. At this time, the values in the different registers are as follows:

| | | | |
|---|---|---|---|
| t[1] = 3, | c[1] = 0, | v[1] = 47; | [uo3] |
| t[2] = 2, | c[2] = 0, | v[2] = 37; | [ie2] |
| t[3] = 2, | c[3] = 0, | v[3] = 37; | [ie2] |
| t[4] = 4, | c[4] = 19, | v[4] = 49; | [zuei4] |
| t[5] = 3, | c[5] = 14, | v[5] = 35; | [xi3] |
| t[6] = 1, | c[6] = 11, | v[6] = 50; | [huan1] |
| t[7] = 4, | c[7] = 7, | v[7] = 22; | [na4] |
| t[8] = 1, | c[8] = 15, | v[8] = 32; | [zhang1] |
| t[9] = 3, | c[9] = 14, | v[9] = 39; | [xiao3] |
| t[10] = 1, | c[10] = 15, | v[10] = 47; | [zhuo1] |
| t[11] = 5, | c[11] = 19, | v[11] = 59 | [z5] |

For the sake of clarity, the monosyllables are arranged in FIG. 4 in the order they appear in the exemplary sentence.

After processing has reached the sentence tail, the value in the i register is once again reset to 1 in step S19 to begin syllable processing from the first syllable. Since it is determined in step S20 that the first syllable does not include a consonant (c[1]=0), the value of the consonant speech duration dc is set to 0 in step S26.

Then, the speech duration of the vowel portion of the first syllable is calculated. According to the vowel designated number v[1]=47, the basic speech duration of 159 ms is obtained from the basic speech duration storage portion 19 of FIG. 5, and is stored in bv in step S27. Next, the following parameters are obtained from the vowel parameter sub-portion (the contents of which are such as those shown in FIG. 7): Since the tone of the syllable to which the vowel belongs is the third tone, a value of 1.3 is obtained and is stored in tv in step S28. Since the syllable is the first syllable of a three-character phrase (wd_phr[1]=(3,1);), a value of 0.85 is obtained and is stored in pv in step S29. Since the syllable is at the head of the sentence, a value of 1.28 is obtained and is stored in sv in step S30. Thereafter, using t[i+1]=37 "ie," which is the rear-connected phoneme for the vowel, as an indexing key, the parameter value +5 is obtained from the vowel environmental effect sub-portion shown in FIG. 8 and is stored in f in step S31. Subsequently, the speech duration for the vowel portion of the syllable is calculated in step S32 to be dv=159*1.3*0.85*1.28+5=230 ms. Thus, the speech duration for the first syllable is calculated to be d[1]=0+230=230 ms and is stored in step S33.

Because it is determined in step S34 that the speech duration for each syllable of the sentence have yet to be decided, the value in the i register is incremented by 1 unit in step S35, and the process flow goes back to step S20. Using the aforesaid process to determine the speech duration of the second syllable "ie2," the values stored in the consonant speech duration dc register and the vowel speech duration dv register are dc=0, and dv=271*1.25*0.8*1+5=276 ms, respectively, in step S32. Thus, the speech duration of the second syllable is found to be d[2]=0+276=276 ms in step S33.

The same process is repeated for the third monosyllable, the fourth monosyllable, . . . up to the eleventh monosyllable "z5." When it is determined in step S34 that the sentence tail has been reached, the speech duration for each syllable is outputted in step S36, and the operation of the apparatus is ended thereafter.

In the present example "我爺爺最, 喜歡那張, 小桌子" "uo3ie2ie2zuei4xi3huan1na4zhang1xiao3zhuo1z5" the speech duration obtained for the each of the syllables are 230, 276, 300, 219, 246, 360, 199, 268, 297, 207, 139, respectively. The values thus obtained are very close to the speech duration measured for natural speech, i.e. 229, 275, 302, 216, 243, 362, 195, 269, 293, 205, 140. Therefore, the present speech duration processing apparatus can provide synthesized speech with natural speech duration.

The present invention should not be limited to the aforesaid embodiment. For example, monosyllables, instead of phonemes, can be used as the basic speech duration calculating unit of the speech duration processing apparatus for Chinese text-to-speech according to the present invention. By modifying the basic speech duration storage portion so as to store the speech duration of monosyllables, and by modifying the parameters of the speech duration parameter storage portion to correspond to parameters tallied for monosyllables, the phoneme inspecting portion and the syllable-phoneme inspecting portion can be omitted at the same time. Furthermore, in the phrase expansion portion of the present apparatus, aside from using phrase expansion syntax to expand adjacent vocabulary into phrases, phrase markers can be added during input. Alternatively, a phrase cache can be constructed such that phrases in the input sentence can be inspected via a comparison method. While the embodiment of the present invention uses Chinese as an example, the speech duration processing apparatus can be implemented in text-to-speech systems of other languages as well.

From the foregoing, the present invention not only considers the effects of phonemes, tones, locations of the phonemes in the sentence, and the front and rear connected phonemes, on the speech duration of the phonemes, but also considers the effects of the phrase construction in the sentence and the locations of the phonemes in the phrases on the speech duration of the phonemes. Thus, the problem of non-standard speech duration in the prior art can be overcome, and speech duration data of synthesized speech that are more accurate than those in the prior art can be generated, thereby providing high quality speech synthesizing.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A speech duration processing method for a Chinese text-to-speech system using Chinese phonemes as a basic processing unit, the method comprising:

constructing a dictionary that stores Chinese vocabulary and corresponding information including phonetic markers, parts of speech, and expansion syntax;

constructing a syllable-phoneme look-up portion that stores information including at least one of consonant designated numbers and vowel designated numbers corresponding to each Chinese syllable;

constructing a basic speech duration storage portion that stores basic speech duration information classified according to phonemes;

constructing a speech duration parameter storage portion that stores speech duration parameters associated with tones of the syllables to which each of the phonemes belong, phrase construction, locations in the phrases, locations in the sentence, and class of the adjacent phonemes;

inspecting positions of the syllables of each vocabulary in an input sentence of a variable length by comparison with the vocabulary stored in the dictionary;

generating a phonetic representation of each syllable of each inspected vocabulary according to the phonetic markers stored in the dictionary;

inspecting the part of speech and the expansion syntax of each inspected vocabulary with reference to the dictionary;

combining the vocabulary in the input sentence into phrases according to the expansion syntax and relationship of the parts of speech of adjacent ones of the vocabulary;

inspecting each syllable in the generated phonetic representation by reference to tone markers;

inspecting the phoneme formation of each inspected syllable with reference to the information in the syllable-phoneme look-up portion;

retrieving the basic speech duration information of each inspected phoneme from the basic speech duration storage portion; and calculating the speech duration of each of the inspected phonemes that form each of the inspected syllables from the basic speech duration information and the parameters associated with the tones, the phrase constructions, the locations in the phrases, the locations in the sentence, and the class of the adjacent phonemes of the inspected phonemes, and combining the speech duration of the inspected phonemes to obtain the speech duration of each of the inspected syllables.

2. A speech duration processing method for a Chinese text-to-speech system using Chinese syllables as a basic processing unit, the method comprising:

constructing a dictionary that stores Chinese vocabulary and corresponding information including phonetic markers, parts of speech, and expansion syntax;

constructing a basic speech duration storage portion that stores basic speech duration information classified according to syllables;

constructing a speech duration parameter storage portion that stores speech duration parameters associated with tones of each of the syllables, phrase constructions, locations in the phrases, locations in the sentence, and class of the adjacent syllables;

inspecting positions of the syllables of each vocabulary in an input sentence of variable length by comparison with the vocabulary stored in the dictionary;

generating a phonetic representation of each syllable of each inspected vocabulary according to the phonetic markers stored in the dictionary;

inspecting the part of speech and the expansion syntax of each inspected vocabulary with reference to the dictionary;

combining the vocabulary in the input sentence into phrases according to the expansion syntax and relationship of the parts of speech of adjacent ones of the vocabulary; inspecting each syllable in the generated phonetic representation by reference to tone markers;

retrieving the basic speech duration information of each inspected syllable from the basic speech duration storage portion; and calculating the speech duration of each of the inspected syllables from the basic speech duration information and the parameters associated with the tones, the phrase construction, the locations in the phrases, the locations in the sentence, and the class of the adjacent syllables of the inspected syllables.

3. A speech duration processing apparatus for a Chinese text-to-speech system using Chinese phonemes as a basic processing unit, the apparatus comprising:

a dictionary that stores Chinese vocabulary and corresponding information including phonetic markers, parts of speech, and expansion syntax;

a syllable-phoneme look-up portion that stores information including at least one of consonant designated numbers and vowel designated numbers corresponding to each Chinese syllable;

a basic speech duration storage portion that stores basic speech duration information classified according to the phonemes;

a speech duration parameter storage portion that stores speech duration parameters associated with tones of the syllables to which each of the phonemes belong, phrase construction, locations in the phrases, locations in the sentence, and class of the adjacent phonemes;

a vocabulary inspector that inspects positions of the syllables of each vocabulary in an input sentence of variable length by comparison with the vocabulary stored in the dictionary;

a phonetic marker generator that generates a phonetic representation of each syllable of each inspected vocabulary according to the phonetic markers stored in the dictionary;

a part of speech/expansion syntax inspector that inspects the part of speech and the expansion syntax of each inspected vocabulary with reference to the dictionary;

a phrase expander that combines the vocabulary in the input sentence into phrases according to the expansion syntax and relationship of the parts of speech of adjacent ones of the vocabulary;

a tone/syllable inspector that inspects each syllable in the generated phonetic representation by reference to tone markers;

a phoneme inspector that inspects the phoneme formation of each of the inspected syllables with reference to the information in the syllable-phoneme look-up portion;

a basic speech duration decider that retrieves the basic speech duration information of each of the inspected phonemes from the basic speech duration storage portion; and a syllable speech duration calculator that calculates the speech duration of each of the inspected phonemes that form each of the inspected syllables from the basic speech duration information and the parameters associated with the tones, the phrase constructions, the locations in the phrases, the locations in the sentence, and the class of the adjacent phonemes of the inspected phonemes, and that combines the speech duration of the inspected phonemes to obtain the speech duration of each of the inspected syllables.

4. A speech duration processing apparatus for a Chinese text-to-speech system using Chinese syllables as a basic processing unit, the apparatus comprising:

a dictionary that stores Chinese vocabulary and corresponding information including phonetic markers, parts of speech, and expansion syntax;

a basic speech duration storage portion that stores basic speech duration information classified according to syllables;

a speech duration parameter storage portion that stores speech duration parameters associated with tones of each of the syllables, phrase construction, locations in the phrases, locations in the sentence, and class of the adjacent syllables;

a vocabulary inspector that inspects positions of the syllables of each vocabulary in an input sentence of variable length by comparison with the vocabulary stored in the dictionary;

a phonetic marker generator that generates a phonetic representation of each syllable of each inspected vocabulary according to the phonetic markers stored in the dictionary;

a part of speech/expansion syntax inspector that inspects the part of speech and the expansion syntax of each inspected vocabulary with reference to the dictionary;

a phrase expander that combines the vocabulary in the input sentence into phrases according to the expansion syntax and relationship of the parts of speech of adjacent ones of the vocabulary;

a tone/syllable inspector that inspects each syllable in the generated phonetic representation by reference to tone markers;

a basic speech duration decider that retrieves the basic speech duration information of each inspected syllable from the basic speech duration storage portion; and a syllable speech duration calculator that calculates the speech duration of each of the inspected syllables from the basic speech duration information and the parameters associated with the tones, the phrase constructions, the locations in the phrases, the locations in the sentence, and the class of the adjacent syllables of the inspected syllables.

* * * * *